US006739461B1

(12) United States Patent
Robinson

(10) Patent No.: US 6,739,461 B1
(45) Date of Patent: May 25, 2004

(54) ADJUSTABLE MERCHANDISE DISPLAY APPARATUS

(76) Inventor: Isadore W. Robinson, 9 Laurel Dr., Huntington, NY (US) 11743

( * ) Notice: Subject to any disclaimer, the term of this patent is extended or adjusted under 35 U.S.C. 154(b) by 0 days.

(21) Appl. No.: 10/349,300

(22) Filed: Jan. 22, 2003

(51) Int. Cl.[7] ..... A47F 5/00

(52) U.S. Cl. ..... 211/59.2; 211/175; 211/183; 428/116

(58) Field of Search ..... 428/116, 119, 428/167, 179, 181; 211/59.2, 59.3, 175, 183

(56) References Cited

U.S. PATENT DOCUMENTS 3,892,898 A * 7/1975 Yasui ..... 428/116
4,461,388 A * 7/1984 Bustos
4,519,508 A * 5/1985 Gullett et al. ..... 211/59.2
4,742,922 A * 5/1988 Demarest ..... 211/175 X
4,947,999 A * 8/1990 Warp ..... 211/183
5,139,842 A * 8/1992 Sewell ..... 428/116
5,295,596 A * 3/1994 Squitieri ..... 211/175
5,624,042 A * 4/1997 Flum et al. ..... 211/59.2
5,695,077 A * 12/1997 Jay ..... 211/59.2
5,868,262 A * 2/1999 Carson ..... 211/59.2
6,142,316 A * 11/2000 Harbour et al. ..... 211/59.2

* cited by examiner

*Primary Examiner*—Robert W. Gibson, Jr.
(74) *Attorney, Agent, or Firm*—George J. Jakobsche

(57) ABSTRACT

An easily adjusted apparatus for storing and dispensing cans, bottles and other containers, i.e. an adjustable merchandise slide, includes an adjustable mesh of ribs and deformable connecting members, as well as partitions, front panels and locking members attached to the mesh. The mesh, partitions and front panels define channels for holding rows of containers. The mesh is configured to be expanded or compressed as needed to make the channels wider or narrower. Each channel's width can be separately adjusted. The locking members attach to the mesh to maintain a desired width for each channel.

12 Claims, 8 Drawing Sheets

ADJUSTABLE MERCHANDISE DISPLAY APPARATUS

BACKGROUND OF THE INVENTION

1. Field of the Invention

The present invention relates generally to apparatus used to store, display and dispense merchandise, such as devices used in supermarkets to store, display and dispense beverage containers, and, more particularly, to adjustable storage, display and dispensing apparatus.

2. Description of the Prior Art

Merchandise display apparatus (sometimes refer to as "merchandise slides" or "gondola displays") are known mechanical devices for organizing containers, typically beverage containers, in store displays, such as inside refrigerated display cases. For example, merchandise slides are used in grocery stores, convenience stores, pizza shops, etc. to facilitate self-service by customers. A typical merchandise slide has a plurality of parallel partitions defining a plurality of parallel channels. Each channel contains a row of containers. To accommodate a mixture of containers sizes, each channel can be a different width. The whole merchandise slide is typically inclined approximately 10 or 15 degrees toward the front of the slide, so when a customer removes a container from one of the channels, containers in the channel behind the removed container slide or roll forward, due to the force of gravity. Each channel has a front panel to prevent the containers from sliding or rolling beyond the front edge of the apparatus.

Some merchandise display apparatus include wheels or rollers, on which the merchandise rolls, rather than sliding, along the bottom of the channels. Other merchandise display apparatus use springs or other means to urge the rows of containers toward the front panel, eliminating the need to incline the apparatus. Still other merchandise display apparatus do not employ any means to urge the rows of containers towards the front of the apparatus. I will refer to all merchandise display apparatus that employ channels to contain rows of merchandise as "merchandise slides" or, alternatively, "merchandise display apparatus".

Containers come in many different sizes, so the channels' widths must match the sizes of the containers to be displayed. It is important to closely match a channel's width to the size of the containers to be stored in the channel, because, if the channel is too small, the containers will not fit, and, if the channel is too wide, the whole merchandise display apparatus will be wider than necessary and will, consequently, waste shelf space. Making the channels too wide reduces the number of channels that can fit in a given amount of shelf space. For example, if each channel of a typical merchandise slide were only ¼ inch wider than necessary, one fewer channel would fit on a 30-inch shelf of a refrigerated display case than if each channel were properly sized. This poses a problem, because merchants generally wish to be able to display as many different products as possible in a given amount of shelf space.

Problematically, the channel widths of many merchandise display apparatus are set by their respective manufacturers and are not adjustable. Other merchandise display apparatus have adjustable channel widths, however these units are expensive, difficult to adjust and/or needlessly complex.

It is, therefore, an object of the present invention to overcome many of the disadvantages and shortcomings associated with prior art devices and to provide an inexpensive, easy to adjust merchandise display apparatus.

SUMMARY OF THE INVENTION

The present invention is directed to an easily adjustable apparatus for storing and dispensing cans, bottles and other merchandise, i.e. an adjustable merchandise slide. The adjustable merchandise slide includes an adjustable mesh of ribs and deformable connecting members, as well as partitions, front panels and locking members attached to the mesh. The mesh, partitions and front panels define channels for holding rows of merchandise. The mesh is configured to be expanded or compressed as needed to make the channels wider or narrower. Each channel's width can be separately adjusted. The locking members attach to the mesh to maintain a desired width for each channel.

A number of aspects of the invention are summarized below, along with different embodiments that may be implemented for each of the summarized aspects. These embodiments are not necessarily inclusive or exclusive of each other and can be combined in any manner that is not conflicting and is otherwise possible. These summarized aspects of the invention are only exemplary and are not to be considered limiting.

In one aspect of the invention, an adjustable merchandise display apparatus includes a plurality of substantially parallel, spaced-apart ribs. Adjacent ones of these ribs are separated from each other by a respective adjustable inter-rib spacing. The adjustable merchandise display apparatus also includes a plurality of deformable connecting members. These deformable connecting members interconnect the adjacent ribs to each other. The deformable connecting members are configured to deform as the respective inter-rib spacing is adjusted.

BRIEF DESCRIPTION OF THE DRAWINGS

The present invention can be better understood by referring to the following detailed description of a preferred embodiment in conjunction with the accompanying drawings, in which like items have like reference numerals, and the first digit or first and second digits of the reference numeral of each item identifies a figure, in which the item is first introduced.

DETAILED DESCRIPTION OF THE PREFERRED EMBODIMENT

Figure 1:
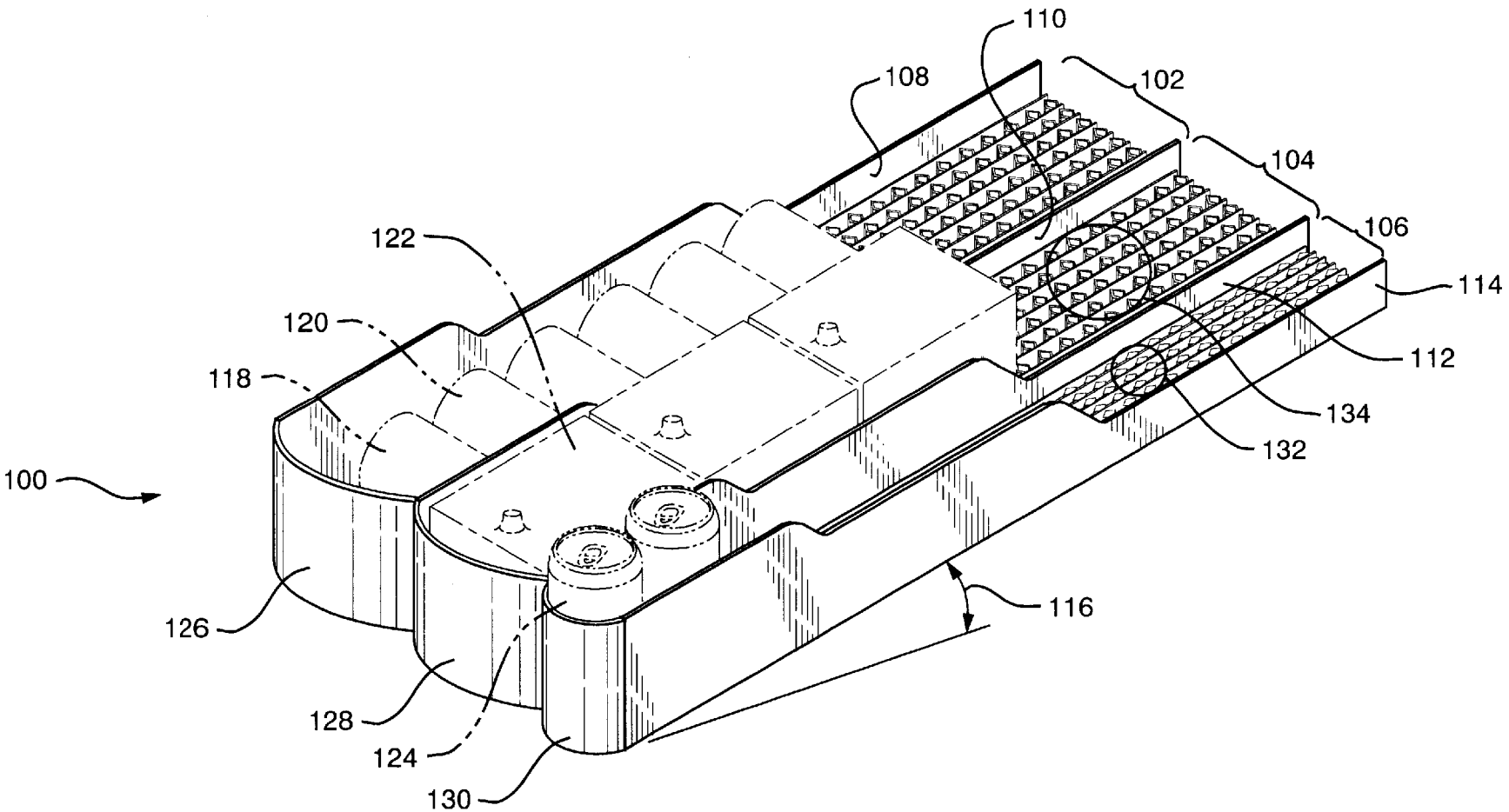
FIG. 1 is an isometric view of one embodiment of an adjustable merchandise slide according to the present invention.

FIG. 1 shows an adjustable merchandise slide 100 that employs the present invention. The adjustable merchandise slide 100 includes three channels 102, 104 and 106, although adjustable merchandise slides can have any number of channel(s). The channels 102–106 are defined by partitions 108, 110, 112 and 114. The entire adjustable merchandise slide 100 is inclined about 10 or 15 degrees 116, so merchandise, such as containers 118, 120, 122 and 124, in the channels 102–106, are urged by gravity to slide or roll along the channels toward respective front panels 126, 128 and 130. These front panels 126–130 prevent the containers 118–124 from sliding or rolling beyond the front edge of the adjustable merchandise slide 100. When a customer removes one of the containers 118–124 from the front of the adjustable merchandise slide 100, remaining containers in the channel 102, 104 or 106 thereafter slide or roll forward toward the front panel 126, 128 or 130 to take the place of the removed container. The partitions 108–114 are placed so that the respective widths of the channels 102–106 accommodate the respective sizes of the containers 118–124.

Figure 2:
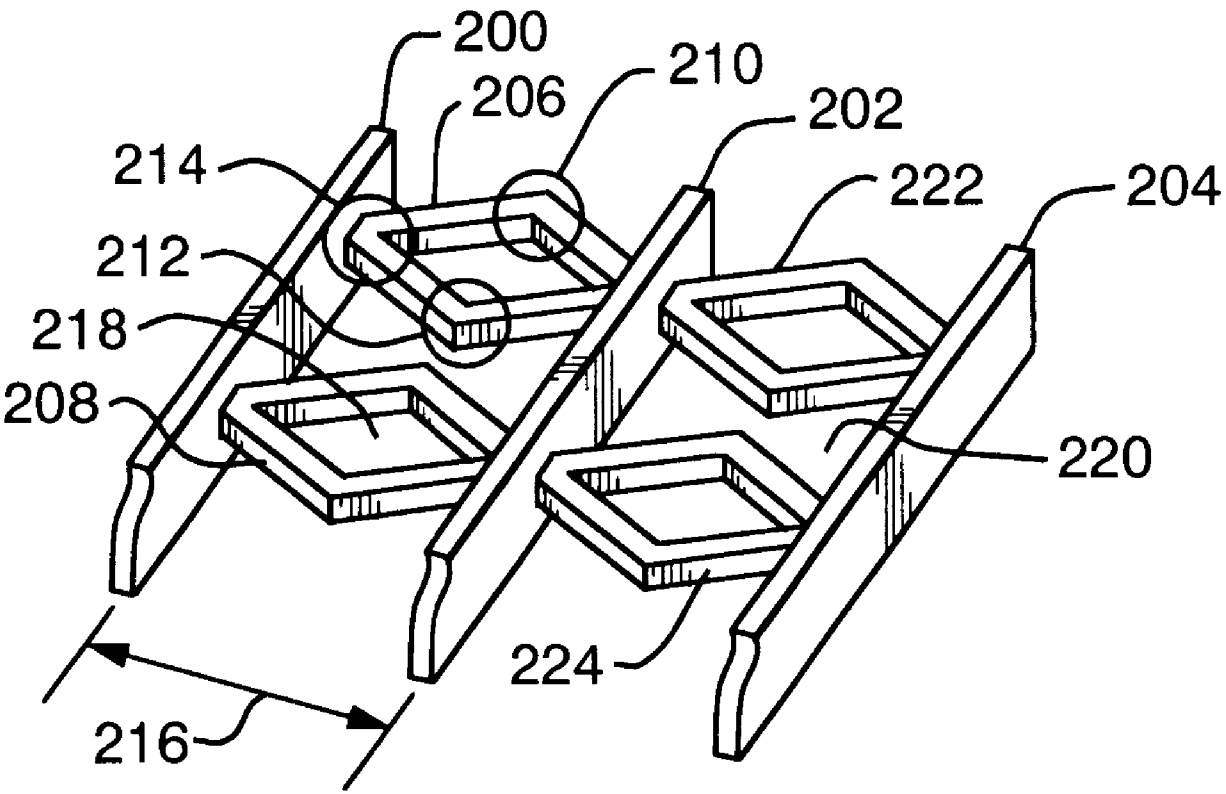
FIG. 2 is a close-up view of a portion of the mesh of the adjustable merchandise slide of FIG. 1.

The bottom of each channel 102–106 includes a plurality of substantially parallel, spaced-apart ribs, such as the ribs identified at 132 and 134. The containers 118–124 slide or roll on these ribs. FIG. 2 shows details of three of these ribs 200, 202 and 204. Adjacent ribs, such as ribs 200 and 202, are connected to each other by a plurality of deformable connecting members, such as connecting members 206 and 208. The connecting members are preferably diamond shaped, however other shapes are described below. Collectively, the ribs and the connecting members of the channel(s) create a mesh. Each partition 108–114 is connected to the mesh, typically to one of the ribs.

Each deformable connecting member, such as connecting member 206, has at least one flexible region where the connecting member can bend or deform. For example, the connecting member 206 can bend or deform at flexible regions 210, 212, 214 and a flexible region that is obscured by rib 202. The adjacent ribs 200 and 202 are separated from each other by an adjustable inter-rib spacing 216, and, if this inter-rib spacing is changed, i.e. if the mesh is expanded or compressed, the flexible regions of the connecting members 206 and 208 bend or deform. Since the partitions 108–114 are connected to the mesh, the channel widths defined by the partitions change as the inter-rib spacing changes.

Figure 3A:
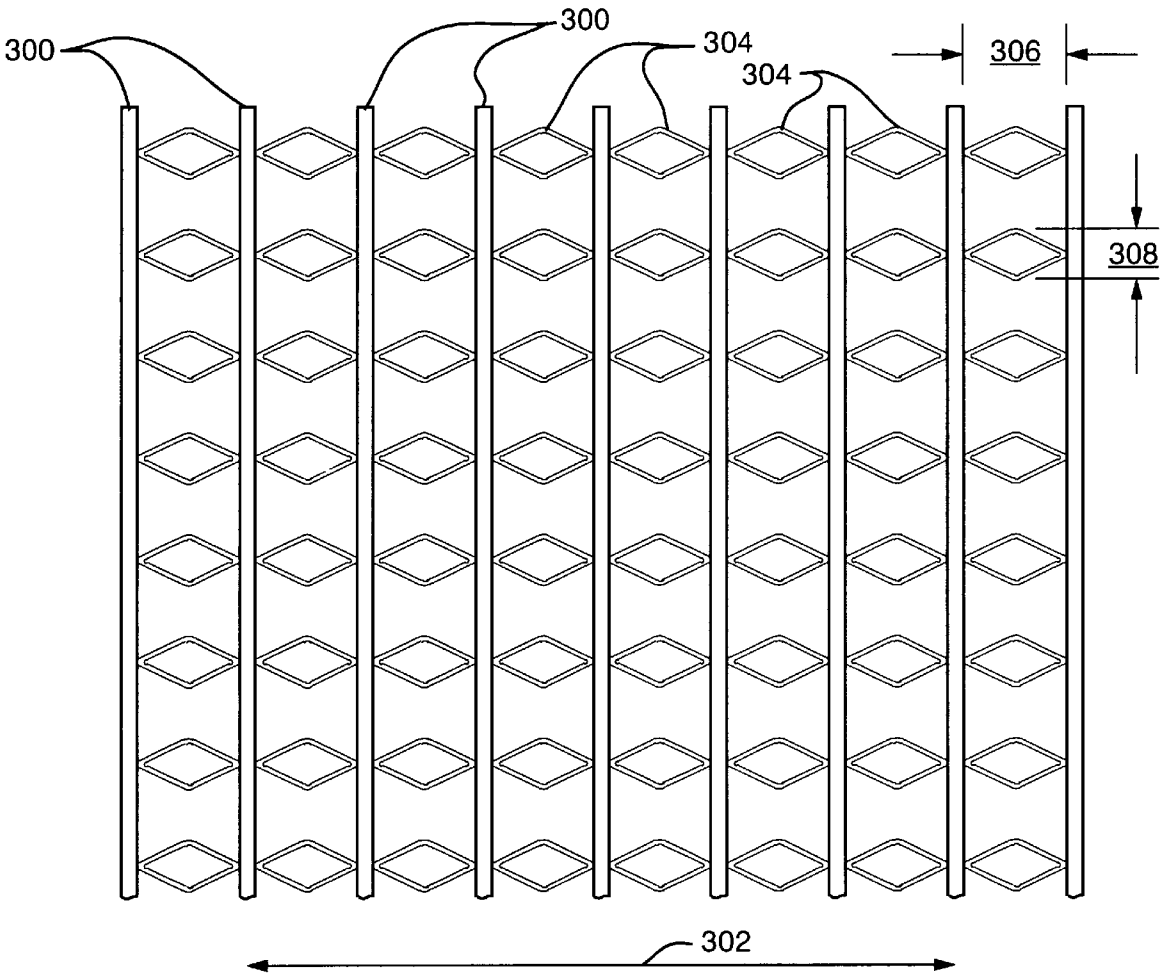
FIG. 3*a* is a view of the mesh of FIG. 2, when the mesh is expanded.

For example, as shown in FIG. 3*a*, if the ribs 300 are spread apart in a direction 302 to accommodate a large container, such as container 122 in FIG. 1, the diamond shaped connecting members 304 deform by expanding along one dimension 306 and compressing along a different dimension 308.

Figure 3B:
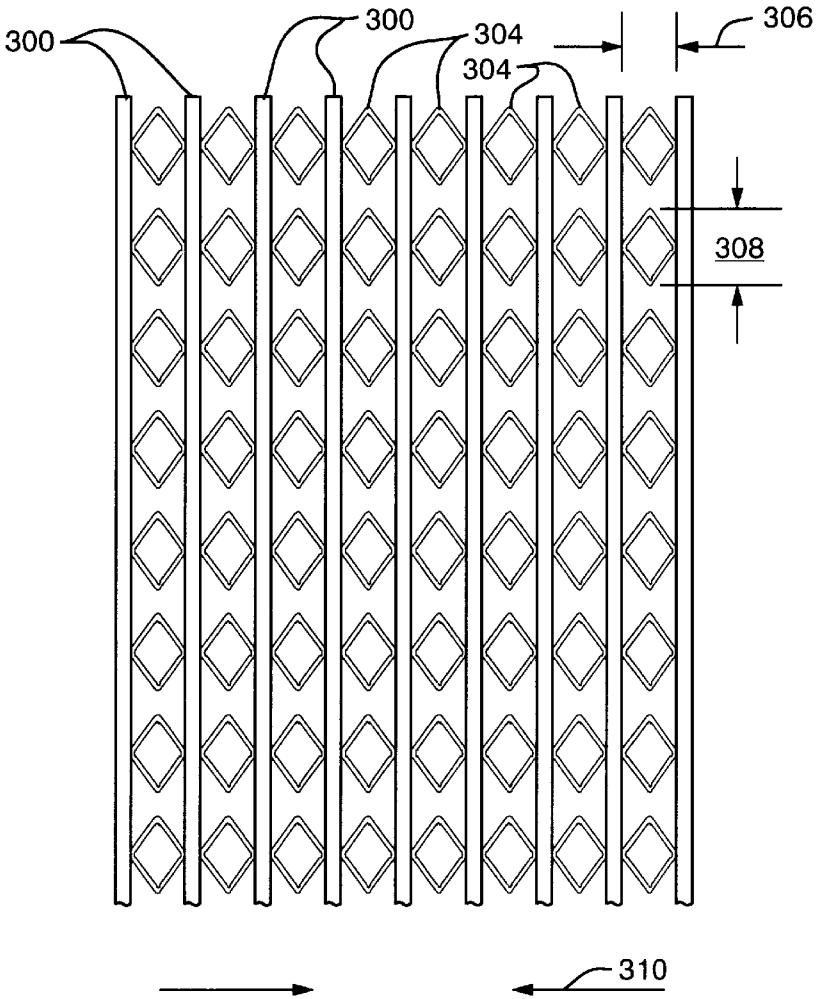
FIG. 3*b* is a view of the mesh of FIG. 2, when the mesh is compressed.

On the other hand, as shown in FIG. 3*b*, if the ribs 300 are compressed in a direction 310 to accommodate a small container, such as container 124 in FIG. 1, the diamond shaped connecting members 304 deform by compressing along one dimension 306 and expanding along a different dimension 308.

Figure 4:
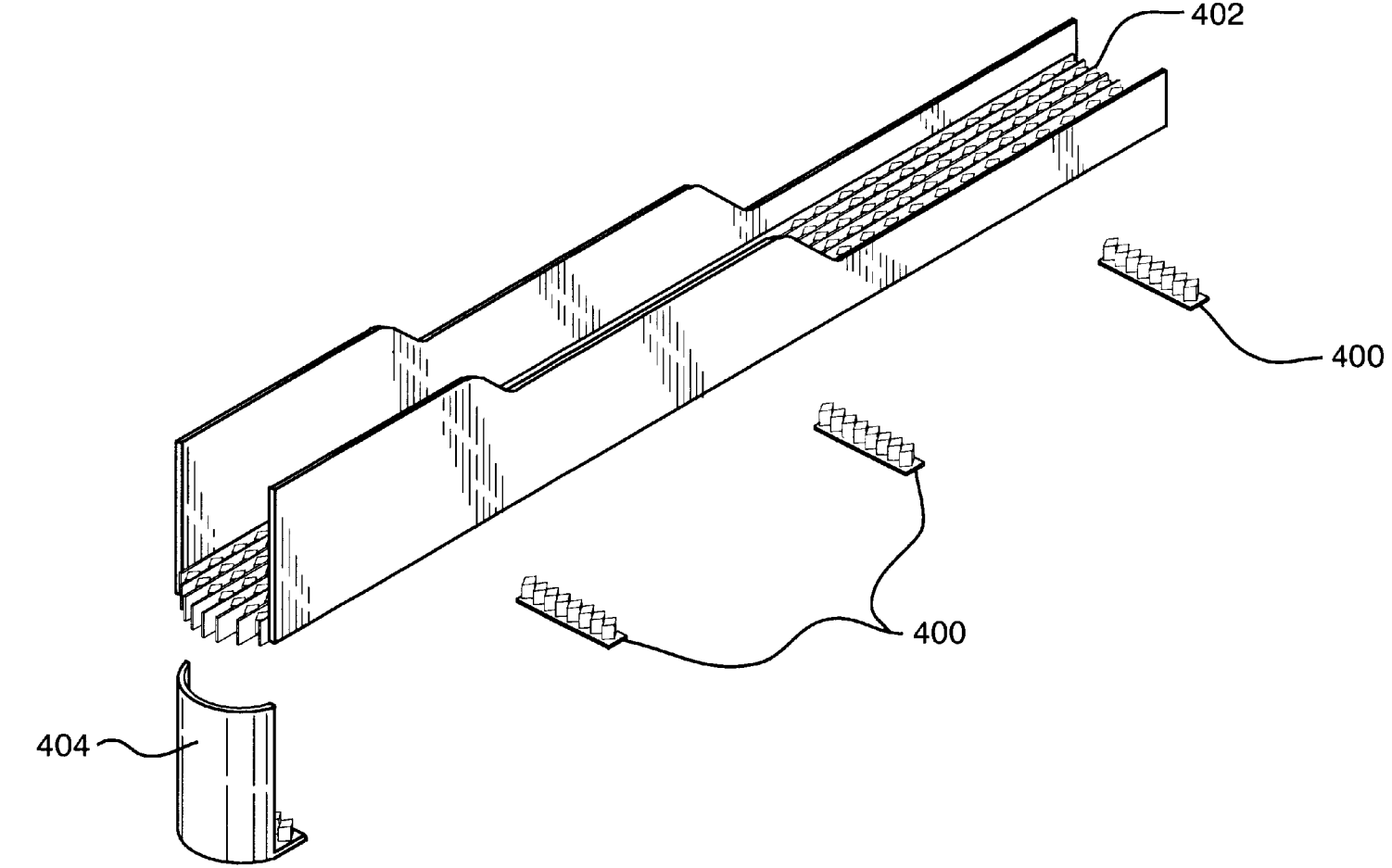
FIG. 4 is an exploded view of one channel of the merchandise slide of FIG. 1.
Figure 5:
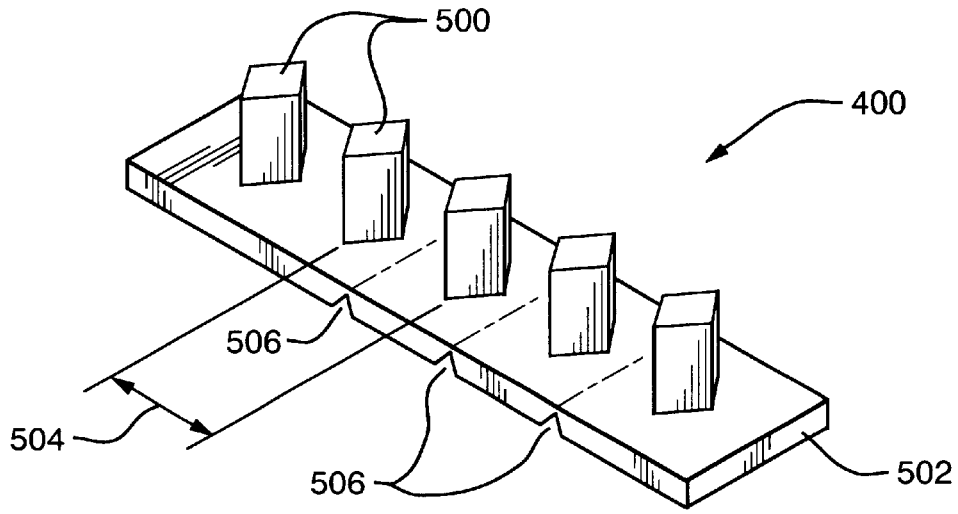
FIG. 5 is an enlarged view of a locking member of the merchandise slide of FIG. 1.

As shown in FIG. 4, at least one locking member 400 is attached to the mesh to maintain a selected inter-rib spacing. As shown in FIG. 5, the locking member 400 includes one or more plugs 500 attached to each other, such as by a base 502. Each plug 500 is shaped to fit into an opening 218 (FIG. 2) defined by one of the connecting members 208 or into an opening 220 defined by a combination of connecting members 222, 224 and/or ribs 202, 204. As shown in 20 FIG. 4, the locking member 400 preferably attaches into the bottom of the mesh 402, although the locking member can also attach otherwise, such as to the top of the mesh. Preferably, the front panel 404 includes a locking member to attach to the mesh 402.

The shape of the plugs 500 (FIG. 5) and/or the spacing 504 of the plugs is chosen to maintain a desired inter-rib spacing. Of course, each channel 102–106 can have a different width, i.e. locking members 400 having differently shaped plugs 500 and/or different spacings 504 can be used for each channel. To reconfigure the channel width(s), the locking member(s) can be removed, the channel(s) can be resized, i.e. the mesh can be compressed or expanded, and different locking member(s) can be then be installed.

Alternatively, the plugs 500 can be shaped to fit around the outside shape of deformable connecting members.

Figure 6:
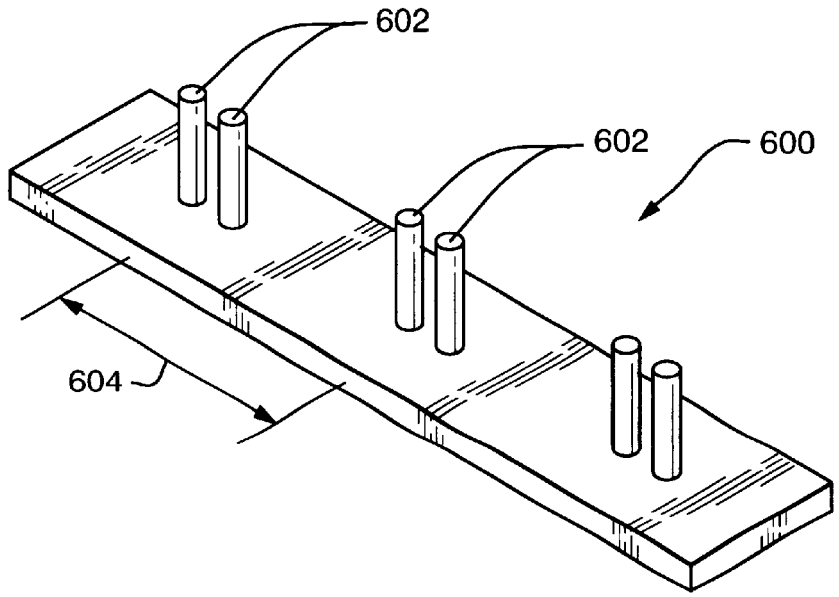
FIG. 6 is an enlarged view of an alternative locking member.
Figure 7A:
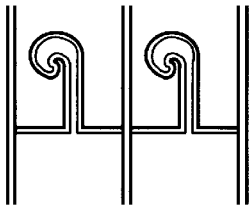
FIGS. 7A–7J are diagrams of various alternative deformable connecting members.
Figure 7B:
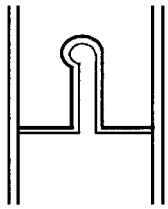
Figure 7C:
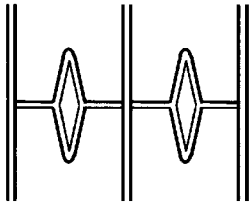
Figure 7D:
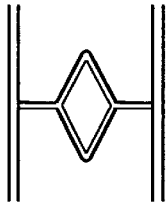
Figure 7E:
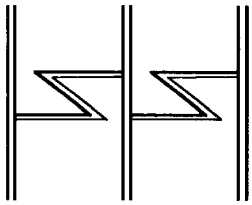
Figure 7F:
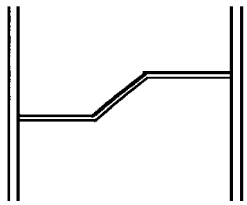
Figure 7G:
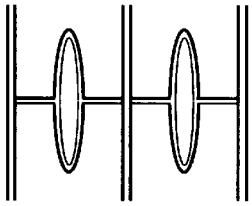
Figure 7H:
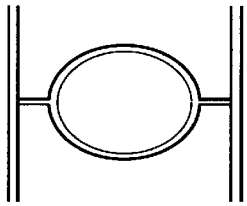
Figure 7I:
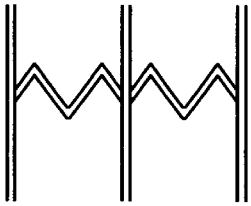
Figure 7J:
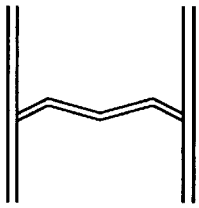

FIG. 6 shows an alternative locking member 600 having pins 602 positioned and spaced apart 604 to straddle at least some of the ribs 300 (FIG. 3*a* or FIG. 3*b*) and/or portions of the connecting members 304 of the mesh to maintain a desired inter-rib spacing 216 (FIG. 2) or one of several inter-rib spacings.

The mesh 402 (FIG. 4) and the locking members 400 (FIG. 5) are preferably molded from plastic. The mesh 402 and a set of variously sized locking members 400 can be molded together as a single unit and the locking members can be broken off the unit and used when needed. Alternatively, the locking members can be molded separately. As shown in FIG. 5, the locking members 400 can have break-off score marks 506 molded into them to facilitate breaking or cutting the locking members into desired lengths.

If the mesh material has sufficient a shape memory, no locking members are required. In such cases, the channels maintain their respective widths after the ribs are spread apart or compressed together. In some embodiments, the mesh can be made from a material that can be deformed in only one direction. For example, if the mesh were made from aluminum, each channel could be made wider several times, however, depending on the material, it might not be possible to then make the channel narrower.

I have described deformable connecting members that have discrete flexible regions, but an entire connecting member, or nonspecific portions thereof, can bend or deform. FIGS. 7A–7J show other shapes for connecting members. FIGS. 7A, 7C, 7E, 7G and 7I show these shapes compressed and FIGS. 7B, 7D, 7F, 7H and 7J show these respective shapes expanded. The list of shapes of connecting members described herein is not exhaustive. Any shape that can interconnect adjacent ribs and can deform is acceptable.

Figure 8:
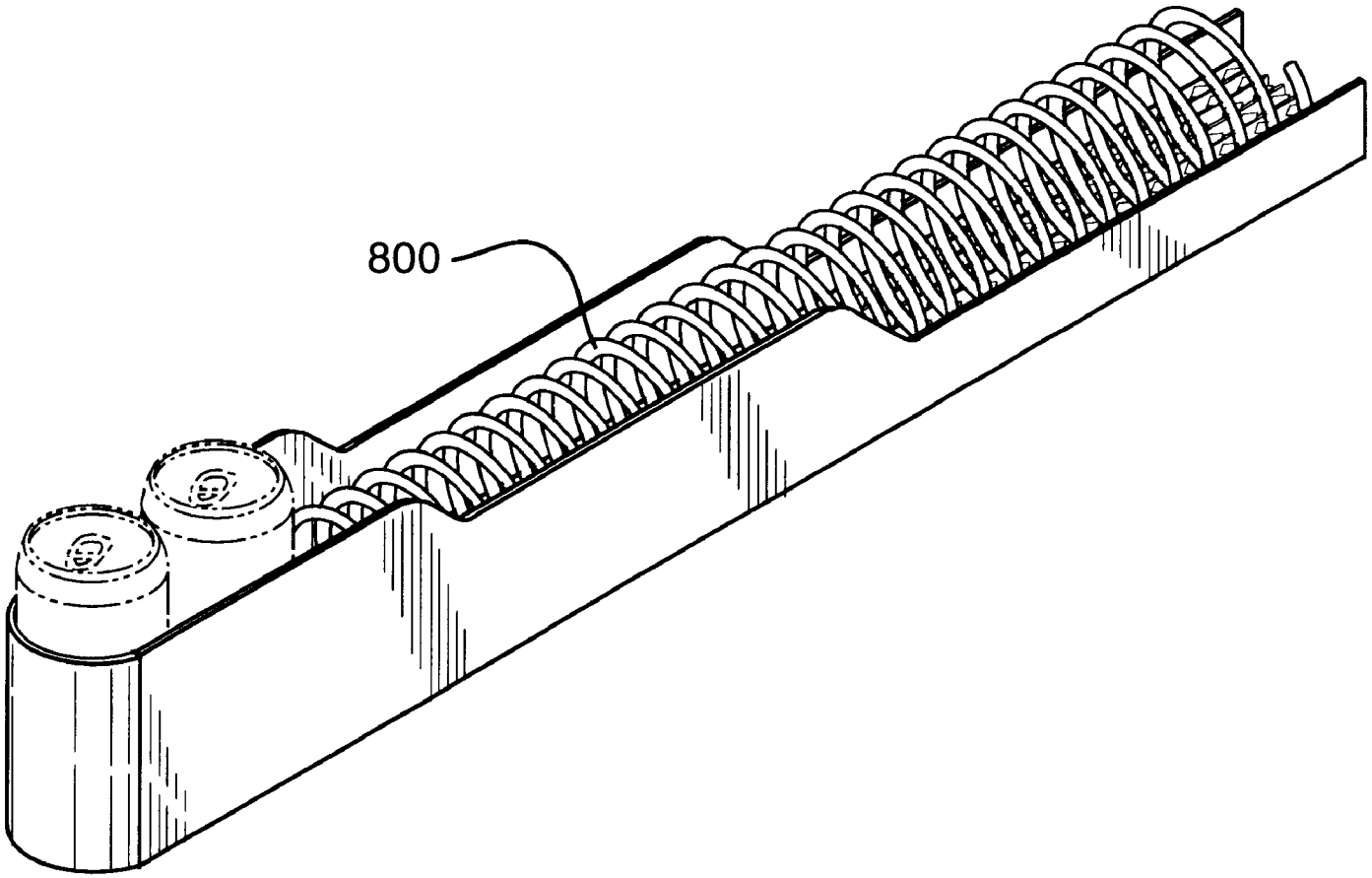
FIG. 8 is a diagram of an alternative configuration of the channel of the merchandise slide of FIG. 1.

Additional ribs can be positioned between the adjacent ribs described above, such as ribs 200 and 202 (FIG. 2), to provide additional support for merchandise containers. The edges of the ribs, upon which the merchandise slides, can be made of a slippery plastic and/or can be coated with a slippery substance, such as Teflon or nylon, to reduce sliding friction between the merchandise and the ribs. Furthermore, merchandise containers need not slide or roll directly on the ribs. Optional wheels or rollers can be attached to the mesh, and the merchandise containers can roll along on top of these wheels or rollers. In addition, as shown in FIG. 8, a spring 800 or other mechanism can be used to urge merchandise containers toward the front panel, instead of inclining the merchandise slide. Alternatively, an adjustable merchandise slide can be constructed and used without employing any means for urging containers forward.

The terms and expressions employed herein are used as terms of description, not of limitation. There is no intention, in using these terms and expressions, to exclude any equivalents of the features shown or described or portions thereof. Practitioners in the art will recognize that modifications are possible within the scope of the invention claimed.

I claim:

1. An adjustable merchandise display apparatus, comprising:

a plurality of substantially parallel, spaced-apart ribs, adjacent ribs being separated from each other by a respective adjustable and readjustable inter-rib spacing; and a plurality of deformable connecting members interconnecting the adjacent ribs to each other, wherein the connecting members are configured to deform as the respective inter-rib spacing is adjusted and readjusted.

2. The adjustable merchandise display apparatus defined in claim 1, further comprising at least one locking member configured to maintain a selected inter-rib spacing.

3. The adjustable merchandise display apparatus defined in claim 2, wherein the at least one locking member is configured to maintain a selected one of a plurality of inter-rib spacings.

4. The adjustable merchandise display apparatus defined in claim 2, wherein the at least one locking member is removable.

5. The adjustable merchandise display apparatus defined in claim 2, further comprising at least one front panel.

6. The adjustable merchandise display apparatus defined in claim 1, further comprising at least two partitions, the two partitions being oriented substantially parallel to the ribs.

7. The adjustable merchandise display apparatus defined in claim 6, wherein:

adjacent partitions are separated from each other by a respective adjustable inter-partition spacing; and further comprising at least one locking member configured to maintain a selected inter-partition spacing.

8. The adjustable merchandise display apparatus defined in claim 7, wherein the at least one locking member is configured to maintain a selected one of a plurality of inter-partition spacings.

9. The adjustable merchandise display apparatus defined in claim 7, wherein the at least one locking member is removable.

10. The adjustable merchandise display apparatus defined in claim 7, further comprising at least one front panel.

11. The adjustable merchandise display apparatus defined in claim 10, wherein the spaced-apart ribs define a plane inclined down toward the at least one front panel, whereby merchandise placed on the spaced-apart ribs is urged by gravity toward the at least one front panel.

12. The adjustable merchandise display apparatus defined in claim 10, wherein:

the adjacent partitions define a channel; and further comprising a spring disposed in the channel for urging merchandise placed in the channel toward the at least one front panel.

* * * * *

UNITED STATES PATENT AND TRADEMARK OFFICE

CERTIFICATE OF CORRECTION

PATENT NO. : 6,739,461 C1
APPLICATION NO. : 90/009723
DATED : May 25, 2004
INVENTOR(S) : Isadore W. Robinson It is certified that error appears in the above-identified patent and that said Letters Patent is hereby corrected as shown below:

In the Specification

Column 1, Line 31
Change "adjacent ribs separated from each other"
To "adjacent ribs being separated from each other"

Column 1, Line 33
Change "upward-facing portions of one of the plurality"
To "upward-facing portions of ones of the plurality"

Signed and Sealed this
Eleventh Day of June, 2013

Teresa Stanek Rea
*Acting Director of the United States Patent and Trademark Office*

US006739461C1

(12) EX PARTE REEXAMINATION CERTIFICATE (8262nd)

United States Patent
Robinson

(10) Number: US 6,739,461 C1
(45) Certificate Issued: May 24, 2011

(54) ADJUSTABLE MERCHANDISE DISPLAY APPARATUS

(76) Inventor: Isadore W. Robinson, Huntington, NY (US)

Reexamination Request:
No. 90/009,723, Apr. 14, 2010

Reexamination Certificate for:

| | |
|---|---|
| Patent No.: | **6,739,461** |
| Issued: | **May 25, 2004** |
| Appl. No.: | **10/349,300** |
| Filed: | **Jan. 22, 2003** |

(51) Int. Cl.
*A47F 5/00* (2006.01)

(52) U.S. Cl. ..... 211/59.2; 211/175; 211/183; 428/116

(58) Field of Classification Search ..... None
See application file for complete search history.

(56) References Cited

U.S. PATENT DOCUMENTS

| | | | | |
|---|---|---|---|---|
| 3,026,078 | A | | 3/1962 | Simkins |
| 3,784,022 | A | * | 1/1974 | Beesley, Jr. ..... 211/59.2 |
| 3,892,898 | A | | 7/1975 | Yasui |
| 5,199,584 | A | | 4/1993 | Fowler et al. |
| 5,203,463 | A | | 4/1993 | Gold |
| 5,232,102 | A | | 8/1993 | Ozawa |
| 6,962,260 | B2 | | 11/2005 | Jay et al. |

FOREIGN PATENT DOCUMENTS

| | | |
|---|---|---|
| WO | 9727789 | 7/1998 |

* cited by examiner

*Primary Examiner*—Cary E. Wehner

(57) ABSTRACT

An easily adjusted apparatus for storing and dispensing cans, bottles and other containers, i.e. an adjustable merchandise slide, includes an adjustable mesh of ribs and deformable connecting members, as well as partitions, front panels and locking members attached to the mesh. The mesh, partitions and front panels define channels for holding rows of containers. The mesh is configured to be expanded or compressed as needed to make the channels wider or narrower. Each channel's width can be separately adjusted. The locking members attach to the mesh to maintain a desired width for each channel.

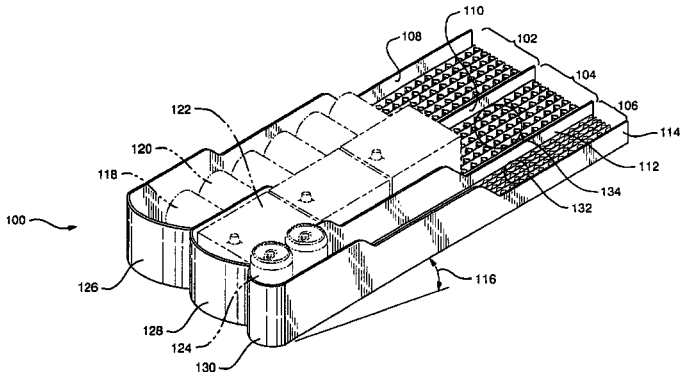

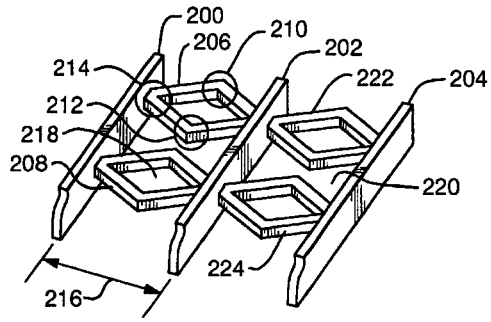

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 6 is cancelled.

Claims 1, 7, 11 and 12 are determined to be patentable as amended.

Claims 2-5 and 8-10 dependent on an amended claim, are determined to be patentable.

New claims 13-20 are added and determined to be patentable.

1. An adjustable merchandise display apparatus, comprising:

a plurality of substantially parallel, spaced-apart ribs, adjacent ribs separated from each other by a respective adjustable and readjustable inter-rib spacing[and], *upward-facing portions of one of the plurality of ribs being configured to:*

*bear weight of displayed merchandise disposed thereon; and*

*define a plane along which bottoms of the displayed merchandise translate when dispensing the merchandise*;

a plurality of deformable connecting members interconnecting the adjacent ribs to each other, wherein the connecting members are configured to deform as the respective inter-rib spacing is adjusted and readjusted*; and*

*a plurality of spaced-apart partitions, each partition being substantially parallel to the plurality of ribs and substantially perpendicular to the plane;*

*wherein adjacent partitions define a respective merchandise channel therebetween, and the plane defines a bottom of the merchandise channel.*

7. The adjustable merchandise display apparatus defined in claim [6] *1*, wherein:

adjacent partitions are separated from each other by a respective adjustable inter-partition spacing; and further comprising at least one locking member configured to maintain a selected inter-partition spacing.

11. The adjustable merchandise display apparatus defined in claim 10, wherein the [spaced-apart ribs define a] plane *is* inclined down toward the at least one front panel, whereby merchandise placed on the *upward-facing portions of ones of the plurality of* spaced-apart ribs is urged by gravity toward the at least one front panel.

12. The adjustable merchandise display apparatus defined in claim 10, [wherein: the adjacent partitions define a channel; and ]

further comprising a spring disposed in the channel [for] *and configured to* [urging] *urge* merchandise placed in the channel toward the at least one front panel.

*13. The adjustable merchandise display apparatus defined in claim 1, wherein the plurality of substantially parallel, spaced-apart ribs comprises at least three substantially parallel, spaced-apart ribs.*

*14. The adjustable merchandise display apparatus defined in claim 1, wherein the plurality of deformable connecting members comprises a plurality of substantially coplanar deformable connecting members.*

*15. The adjustable merchandise display apparatus defined in claim 1, wherein the plurality of spaced-apart partitions comprises at least three spaced-apart partitions.*

*16. The adjustable merchandise display apparatus defined in claim 1, wherein there are at least two ribs of the plurality of substantially parallel, spaced-apart ribs between each pair of adjacent partitions.*

*17. The adjustable merchandise display apparatus defined in claim 1, wherein there are at least three ribs of the plurality of substantially parallel, spaced-apart ribs between each pair of adjacent partitions.*

*18. The adjustable merchandise display apparatus defined in claim 1, wherein each partition of the plurality of spaced-apart partitions is connected to at least one of:*

*at least one rib of the plurality of substantially parallel, spaced-apart ribs; and*

*at least one connecting member of the plurality of deformable connecting members.*

*19. An adjustable merchandise display apparatus, comprising:*

*a plurality of substantially parallel, spaced-apart ribs, adjacent ribs being separated from each other by a respective adjustable and readjustable inter-rib spacing:*

*a plurality of deformable connecting members interconnecting the adjacent ribs to each other, wherein the connecting members are configured to deform as the respective inter-rib spacing is adjusted and readjusted; and*

*a plurality of spaced-apart partitions, each partition being substantially parallel to the plurality of ribs.*

*20. The adjustable merchandise display apparatus defined in claim 19, wherein each partition is connected to at least one of:*

*at least one rib of the plurality of substantially parallel, spaced-apart ribs, and*

*at least one connecting member of the plurality of deformable connecting members.*

* * * * *